US007094332B1

(12) United States Patent
Kalnes et al.

(10) Patent No.: US 7,094,332 B1
(45) Date of Patent: Aug. 22, 2006

(54) INTEGRATED PROCESS FOR THE PRODUCTION OF ULTRA LOW SULFUR DIESEL AND LOW SULFUR FUEL OIL

(75) Inventors: Tom N. Kalnes, LaGrange, IL (US); Vasant P. Thakkar, Des Plaines, IL (US)

(73) Assignee: UOP LLC, Des Plaines, IL (US)

( * ) Notice: Subject to any disclaimer, the term of this patent is extended or adjusted under 35 U.S.C. 154(b) by 533 days.

(21) Appl. No.: 10/430,484

(22) Filed: May 6, 2003

(51) Int. Cl.
*C10G 65/00* (2006.01)
*C10G 67/00* (2006.01)
*C10G 45/00* (2006.01)

(52) U.S. Cl. ..... 208/97; 208/58; 208/210; 208/211

(58) Field of Classification Search ..... 208/97, 208/58, 210, 211
See application file for complete search history.

(56) References Cited

U.S. PATENT DOCUMENTS 2,878,179 A * 3/1959 Hennig ..... 208/57
3,623,974 A * 11/1971 Mounce et al. ..... 208/67
4,016,070 A * 4/1977 Christman et al. ..... 208/210
5,980,729 A * 11/1999 Kalnes et al. ..... 208/89
6,096,191 A 8/2000 Kalnes ..... 208/105
6,328,879 B1 * 12/2001 Kalnes ..... 208/78

* cited by examiner

*Primary Examiner*—Walter D. Griffin
*Assistant Examiner*—John Douglas
(74) *Attorney, Agent, or Firm*—John G. Tolomei; James C. Paschall; John G. Cutts, Jr.

(57) ABSTRACT

A hydrocracking process to produce ultra low sulfur diesel by reacting a first hydrocarbon feedstock in a hydrocracking zone, introducing the hydrocracking zone effluent and a second hydrocarbon feedstock having a majority boiling at a temperature greater than 565° C. (1050° F.) into a first desulfurization zone, passing the first desulfurization zone effluent to a hot, high pressure vapor-liquid separator to recover a vaporous hydrocarbonaceous stream and a first liquid hydrocarbonaceous stream, introducing the vaporous hydrocarbonaceous stream and a third hydrocarbonaceous feedstock comprising diesel into a second desulfurization zone, passing the second desulfurization zone effluent to a cold vapor-liquid separator to provide a hydrogen-rich gaseous stream and a second liquid hydrocarbonaceous stream and passing the first and the second liquid hydrocarbonaceous streams to a fractionation zone to produce ultra low sulfur diesel.

13 Claims, 1 Drawing Sheet

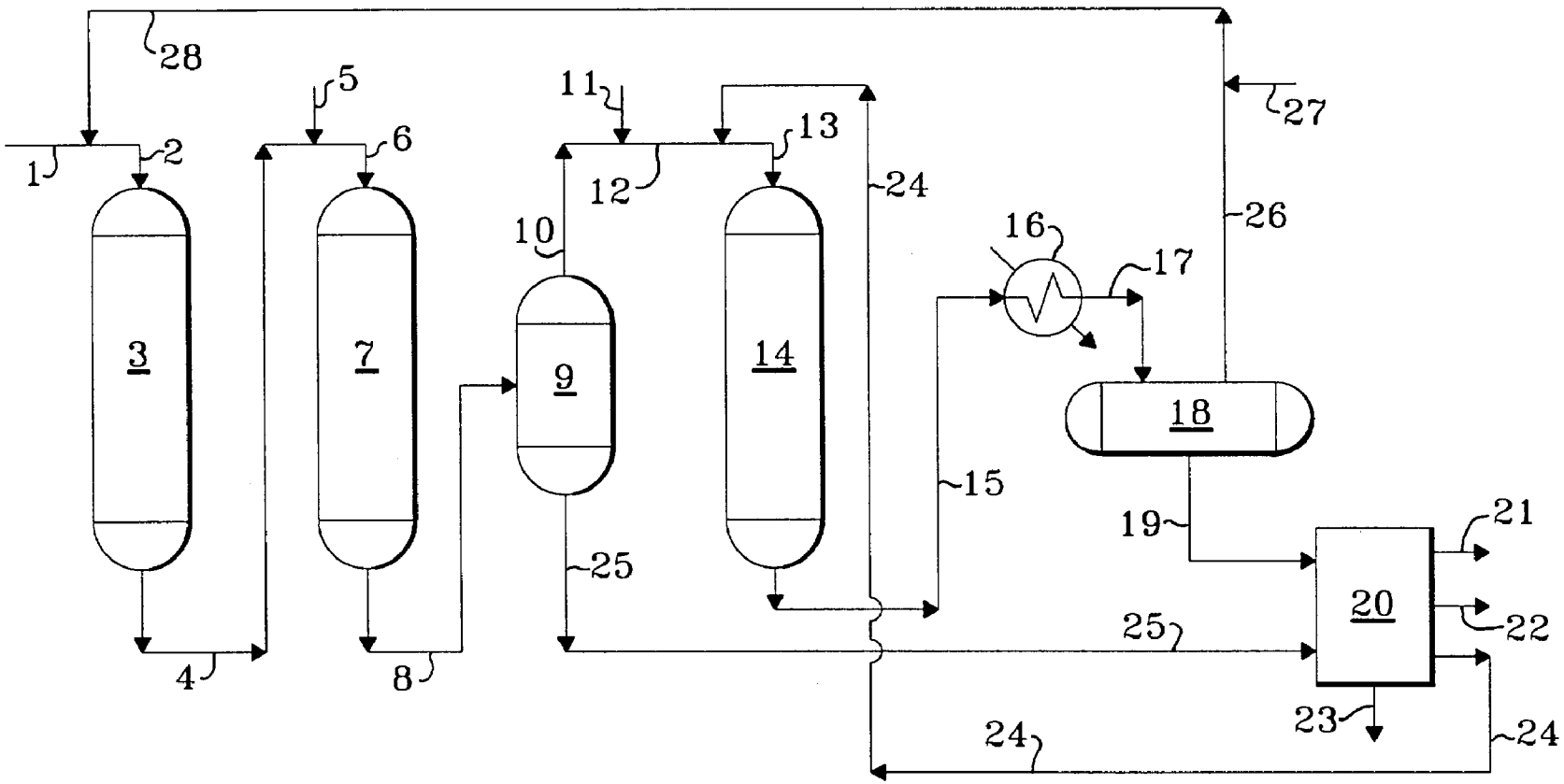
1
2
3
4
5
6
7
8
9
10
11
12
13
14
15
16
17
18
19
20
21
22
23
24
25
26
27
28

INTEGRATED PROCESS FOR THE PRODUCTION OF ULTRA LOW SULFUR DIESEL AND LOW SULFUR FUEL OIL

BACKGROUND OF THE INVENTION

The field of art to which this invention pertains is the hydrocracking of a hydrocarbonaceous feedstock. Petroleum refiners often produce desirable products such as turbine fuel, diesel fuel and other products known as middle distillates as well as lower boiling hydrocarbonaceous liquids such as naphtha and gasoline by hydrocracking a hydrocarbon feedstock derived from crude oil, for example. Feedstocks most often subjected to hydrocracking are gas oils and heavy gas oils recovered from crude oil by distillation. A typical gas oil comprises a substantial portion of hydrocarbon components boiling above about 371° C. (700° F.), usually at least about 50 percent by weight boiling above 371° C. (700° F.). A typical vacuum gas oil normally has a boiling point range between about 315° C. (600° F.) and about 565° C. (1050° F.).

Hydrocracking is generally accomplished by contacting in a hydrocracking reaction vessel or zone the gas oil or other feedstock to be treated with a suitable hydrocracking catalyst under conditions of elevated temperature and pressure in the presence of hydrogen so as to yield a product containing a distribution of hydrocarbon products desired by the refiner. The operating conditions and the hydrocracking catalysts within a hydrocracking reactor influence the yield of the hydrocracked products.

One of the preferred hydrocarbonaceous products from a hydrocracking process is diesel or diesel boiling range hydrocarbons. Marketable products must meet minimum specifications and over the years, it has been recognized that due to environmental concerns and newly enacted rules and regulations, saleable products including diesel fuel must meet lower and lower limits on contaminants such as sulfur and nitrogen. Recently new regulations were proposed in the United States and Europe which basically require the complete removal of sulfur from liquid hydrocarbons which are used as transportation fuels such as gasoline and diesel.

Although a wide variety of process flow schemes, operating conditions and catalysts have been used in commercial hydrocracking activities, there is always a demand for new hydrocracking methods which provide lower costs and improved product characteristics. The present invention is able to economically hydrocrack a hydrocarbonaceous feedstock while simultaneously producing ultra low sulfur diesel product and low sulfur fuel oil.

Residual oils are the liquid or semi-liquid products recovered as a non-distillable bottoms fraction or residue in the distillation of petroleum. The residual oils are highly carbonaceous refractory materials variously referred to as asphaltum oil, liquid asphalt, black oil, petroleum tailings, residium, residual reduced crude, atmospheric tower bottoms and vacuum tower bottoms. In general, the hydrotreating of residual oils is designed for the conversion of $C_7$-insoluble asphaltenes and other hydrocarbonaceous matter to more valuable petroleum products and separation of sulfurous components to render the residual oil more useful.

Information Disclosure

U.S. Pat. No. 6,096,191 B 1 discloses a catalytic hydrocracking process wherein a hydrocarbonaceous feedstock and a liquid recycle stream are contacted with hydrogen and a hydrocracking catalyst to obtain conversion to lower boiling hydrocarbons. The resulting effluent from the hydrocracking zone is hydrogen stripped at essentially the same pressure as the hydrocracking zone and at least a portion is recycled to the hydrocracking reaction zone.

BRIEF SUMMARY OF THE INVENTION

The present invention is an integrated hydrocracking process which hydrocracks a first feedstock while desulfurizing a second feedstock having a majority boiling at a temperature greater than about 565° C. (1050° F.) in a first desulfurization zone and desulfurizing a third feedstock comprising diesel boiling range hydrocarbons in a second desulfurization zone. At least a portion of the diesel boiling range hydrocarbons produced in the hydrocracking zone are desulfurized in the second desulfurization zone.

Other embodiments of the present invention encompass further details such as types and descriptions of feedstocks, hydrocracking catalysts, desulfurization catalysts and preferred operating conditions including temperatures and pressures, all of which are hereinafter disclosed in the following discussion of each of these facets of the invention.

BRIEF DESCRIPTION OF THE DRAWING

The drawing is a simplified process flow diagram of a preferred embodiment of the present invention. The above described drawing is intended to be schematically illustrative of the present invention and is not to be a limitation thereof.

DETAILED DESCRIPTION OF THE INVENTION

An integrated hydrocracking process has been discovered which is capable of desulfurizing a heavy residual hydrocarbonaceous feedstock and desulfurizing a feedstock comprising diesel boiling range hydrocarbons to produce ultra low sulfur diesel.

The first feedstock to the hydrocracking process is preferably gas oil feedstocks containing hydrocarbon components which boil above about 288° C. (550° F.) and more preferably feeds containing at least 25 volume percent boiling between about 315° C. (600° F.) and 538° C. (1000° F.). Preferred feedstocks include atmospheric gas oils, vacuum gas oils, and coker distillates.

The first feedstock is reacted with hydrogen in a hydrocracking zone containing hydrocracking catalyst to produce diesel boiling range hydrocarbons. The hydrocracking zone may contain one or more beds of the same or different catalyst. In one embodiment, the preferred hydrocracking catalysts utilize amorphous bases or low-level zeolite bases combined with one or more Group VIII or Group VIB metal hydrogenating components. In another embodiment, the hydrocracking zone may contain a catalyst which comprises, in general, any crystalline zeolite cracking base upon which is deposited a Group VIII metal hydrogenating component. Additional hydrogenating components may be selected from Group VIB for incorporation with the zeolite base. The zeolite cracking bases are sometimes referred to in the art as molecular sieves and are usually composed of silica, alumina and one or more exchangeable cations, such as sodium, magnesium, calcium, rare earth metals, etc. They are further characterized by crystal pores of relatively uniform diameter between about 4 and 14 Angstroms $10^{-10}$ meters). It is preferred to employ zeolites having a relatively high silica/alumina mole ratio between about 3 and 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8–12 Angstroms ($10^{-10}$ meters), wherein the silica/alumina mole ratio is about 4 to 6. A prime example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least 20 percent, metal-cation-deficient, based on the initial ion-exchange capacity. A specifically desirable and stable class of zeolites are those wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., 371°–648° C. (700°–1200° F.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 (Klotz).

The hydrocracking of the first hydrocarbonaceous feedstock in contact with a hydrocracking catalyst is conducted in the presence of hydrogen and preferably at hydrocracking conditions which include a temperature from about 232° C. (450° F.) to about 468° C. (875° F.), a pressure from about 3448 kPa gauge (500 psig) to about 20685 kPa gauge (3000 psig), a liquid hourly space velocity (LHSV) from about 0.1 to about 30 $hr^{-1}$, and a hydrogen circulation rate from about 337 -normal $m^3/m^3$ (2000 standard cubic feet per barrel) to about 4200 normal $m^3/m^3$ (25,000 standard cubic feet per barrel). In accordance with the present invention, the operating conditions are selected to produce diesel boiling range hydrocarbons.

The resulting effluent from the hydrocracking zone is admixed with a second hydrocarbonaceous feedstock having a majority boiling at a temperature greater than about 565° C. (1050° F.) and introduced into a first desulfurization zone containing desulfurization catalyst. The second hydrocarbonaceous feedstock is preferably selected from the group consisting essentially of reduced crude, vacuum reduced crude and tar sand bitumen. Preferred desulfurization conditions include a temperature from about 204° C. (400° F.) to about 482° C. (900° F.) and a liquid hourly space velocity from about 0.1 to about 10 $hr^{-1}$. It is contemplated that the desulfurization zone may also perform other hydroprocessing reactions, such as aromatic saturation, nitrogen removal, cetane improvement, demetallation and color improvement, for example.

Suitable desulfurization catalysts for use in the present invention are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable desulfurization catalysts include zeolitic catalysts, as well as noble metal catalysts where the noble metal is selected from palladium and platinum. It is within the scope of the present invention that more than one type of desulfurization catalyst be used in the same reaction vessel. The Group VIII metal is typically present in an amount ranging from about 2 to about 20 weight percent, preferably from about 4 to about 12 weight percent. The Group VI metal will typically be present in an amount ranging from about 1 to about 25 weight percent, preferably from about 2 to about 25 weight percent. Typical desulfurization temperatures range from about 204° C. (400° F.) to about 482° C. (900° F.) with pressures from about 3.45 MPa (500 psig) to about 20.7 MPa (3000 psig).

The resulting effluent from the first desulfurization zone is passed to a hot, high pressure separator operated at a pressure essentially equal to the pressure in the first desulfurization zone and a temperature in the range from about 204° C. (400° F.) to about 454° C. (850° F.) to recover a vaporous hydrocarbonaceous stream containing hydrogen, and a liquid hydrocarbonaceous stream.

The vaporous hydrocarbonaceous stream containing hydrogen and the third hydrocarbonaceous feedstock containing diesel boiling range hydrocarbons is reacted in a second desulfurization containing desulfurization catalyst. This desulfurization catalyst may be selected from any known desulfurization catalyst, such as that described hereinabove, for example. The type of catalyst in the second desulfurization zone may be the same or different than the catalyst in the first desulfurization zone. The operating conditions in the second desulfurization zone are preferably selected from those desulfurization conditions described hereinabove. The third feedstock containing diesel boiling range hydrocarbons preferably boils in the range from about 149° C. (300° F.) to about 399° C. (750° F.).

The resulting effluent from the second desulfurization zone is cooled, partially condensed and introduced into a cold vapor-liquid separator preferably operated at a temperature from about 15.6° C. (60° F.) to about 60° C. (140° F.) to recover a hydrogen-rich vapor stream which is preferably recycled, at least in part, to the hydrocracking zone, and a liquid hydrocarbonaceous stream.

The liquid hydrocarbonaceous stream containing distillable hydrocarbons and including diesel boiling range hydrocarbons recovered from the cold, high pressure vapor-liquid separator and the liquid hydrocarbon stream containing non-distillable hydrocarbons recovered from the hot, high pressure vapor-liquid separator is preferably introduced into a fractionation zone to produce various hydrocarbon product streams including, for example, a naphtha stream, a kerosene stream, a diesel stream and a heavy hydrocarbonaceous stream containing hydrocarbons boiling at a temperature greater than about 565° C. (1050° F.). At least a portion of the recovered diesel stream is recycled and introduced into the second desulfurization zone to ensure that the net recovered diesel stream meets the required low sulfur specifications.

DETAILED DESCRIPTION OF THE DRAWING

In the drawing, the process of the present invention is illustrated by means of a simplified schematic flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

With reference now to the drawing, a feedstream comprising vacuum gas oil is introduced into the process via line 1 and is admixed with a hydrogen-rich gaseous stream provided via line 28 and the resulting admixture is introduced via line 2 into hydrocracking zone 3. A resulting hydrocracking zone effluent is transported via line 4 and is admixed with a residual oil stream containing compounds boiling at a temperature greater than 565° C. (1050° F.) and the resulting admixture is transported via line 6 and introduced into desulfurization zone 7. A resulting desulfurized stream is removed from desulfurization zone 7 via line 8 and introduced into hot, high pressure vapor-liquid separator 9. A hot liquid hydrocarbonaceous stream is removed from hot high pressure vapor-liquid separator 9 via line 25 and introduced into fractionation zone 20. A vaporous hydrocarbonaceous stream is removed from hot high pressure vapor-liquid separator 9 via line 10 and is joined by a hydrocarbonaceous stream containing diesel boiling range hydrocarbons and the resulting admixture is transported via line 12 and is joined by a recycle stream containing diesel boiling range hydrocarbons provided by line 24 and the resulting admixture is transported via line 13 and introduced into desulfurization zone 14. A resulting desulfurized hydrocarbonaceous stream is removed from desulfurization zone 14 via line 15 and introduced into heat-exchanger 16. A resulting cooled effluent is removed from heat-exchanger 16 via line 17 and introduced into cold high pressure separator 18. A hydrogen-rich gaseous stream is removed from cold high pressure separator 18 via line 26 and is joined by a makeup hydrogen stream provided via line 27 and the resulting admixture is transported via line 28 and joins the fresh feedstock introduced via line 1 as hereinabove described. A liquid hydrocarbonaceous stream is removed from cold high pressure separator 18 via line 19 and introduced into fractionation zone 20. A naphtha stream is removed from fractionation zone 20 via line 21 and recovered. A net diesel stream is removed from fractionation zone 20 via line 22 and recovered. A desulfurized and demetallized, heavy hydrocarbonaceous stream containing compounds boiling at a temperature greater than 565° C. (1050° F.) is removed from fractionation zone 20 via line 23 and recovered. A stream containing diesel boiling range hydrocarbons is removed from fractionation zone 20 via line 24 and is introduced via line 13 into desulfurization zone 14 as described hereinabove.

The foregoing description and drawing clearly illustrate the advantages encompassed by the process of the present invention and the benefits to be afforded with the use thereof.

What is claimed is:

1. A hydrocracking process for the production of ultra low sulfur diesel wherein the process comprises:

(a) reacting a first hydrocarbonaceous feedstock and hydrogen in a hydrocracking zone containing hydrocracking catalyst to produce diesel boiling range hydrocarbons;

(b) introducing a hydrocracking zone effluent produced in step (a) and a second hydrocarbonaceous feedstock having a majority boiling at a temperature greater than about 565° C. (1050° F.) into a first desulfurization zone containing desulfurization catalyst to produce a first desulfurization zone effluent stream;

(c) passing the first desulfurization zone effluent to a hot, high pressure vapor-liquid separator to recover a vaporous hydrocarbonaceous stream containing hydrogen and a first liquid hydrocarbonaceous stream;

(d) introducing the first vaporous hydrocarbonaceous stream containing hydrogen and a third hydrocarbonaceous feedstock comprising diesel boiling range hydrocarbons into a second desulfurization zone containing desulfurization catalyst to produce a second desulfurization zone effluent stream;

(e) passing the second desulfurization zone effluent stream to a cold vapor-liquid separator to recover a hydrogen-rich gaseous stream and a second liquid hydrocarbonaceous stream; and (f) passing the first liquid hydrocarbonaceous stream and the second liquid hydrocarbonaceous stream to a fractionation zone to produce a hydrocarbonaceous stream comprising diesel boiling range hydrocarbons and a hydrocarbonaceous stream comprising hydrocarbons boiling at a temperature great than about 565° C. (1050° F.).

2. The process of claim 1 wherein at least a portion of the hydrocarbonaceous stream comprising diesel boiling range hydrocarbons produced in step (f) is introduced into the second desulfurization zone.

3. The process of claim 1 wherein at least 25% by volume of the first hydrocarbonaceous feedstock boils between about 315° C. (600° F.) and about 538° C. (1000° F.).

4. The process of claim 1 wherein the third hydrocarbonaceous feedstock boils in the range from about 149° C. (300° F.) to about 399° C. (750° F.).

5. The process of claim 1 wherein the hydrocracking zone is operated at conditions which include a temperature from about 232° C. (450° F.) to about 468° C. (875° F.) and a pressure from about 3.45 MPa (500 psig) to about 20.7 MPa (3000 psig).

6. The process of claim 1 wherein at least a portion of the hydrogen-rich gaseous stream recovered in step (e) is introduced into the hydrocracking zone.

7. The process of claim 1 wherein the first desulfurization zone is operated at conditions which include a temperature from about 204° C. (400° F.) to about 482° C. (900° F.) and a pressure from about 3.45 MPa (500 psig) to about 20.7 MPa (3000 psig).

8. The process of claim 1 wherein the second desulfurization zone is operated at conditions which include a temperature from about 204° C. (400° F.) to about 482° C. (900° F.) and a pressure from about 3.45 MPa (500 psig) to about 20.7 MPa (3000 psig).

9. The process of claim 1 wherein the cold vapor-liquid separator is operated at a temperature from about 15.6° C. (60° F.) to about 60° C. (140° F.).

10. The process of claim 1 wherein the first hydrocarbonaceous feedstock comprises a vacuum gas oil.

11. The process of claim 1 wherein the second hydrocarbonaceous feedstock is selected from the group consisting essentially of reduced crude, vacuum reduced crude and tar sand bitumen.

12. A hydrocracking process for the production of ultra low sulfur diesel wherein the process comprises:

(a) reacting a first hydrocarbonaceous feedstock and hydrogen in a hydrocracking zone containing hydrocracking catalyst to produce diesel boiling range hydrocarbons;

(b) introducing a hydrocracking zone effluent produced in step (a) and a second hydrocarbonaceous feedstock having a majority boiling at a temperature greater than about 565° C. (1050° F.) into a first desulfurization zone containing desulfurization catalyst to produce a first desulfurization zone effluent stream;

(c) passing the first desulfurization zone effluent to a hot, high pressure vapor-liquid separator to recover a vaporous hydrocarbonaceous stream containing hydrogen and a first liquid hydrocarbonaceous stream;

(d) introducing the vaporous hydrocarbonaceous stream containing hydrogen and a third hydrocarbonaceous feedstock comprising diesel boiling range hydrocarbons into a second desulfurization zone containing desulfurization catalyst to produce a second desulfurization zone effluent stream;

(e) passing the second desulfurization zone effluent stream to a cold vapor-liquid separator to recover a hydrogen-rich gaseous stream and a second liquid hydrocarbonaceous stream;

(f) passing the first liquid hydrocarbonaceous stream and the second liquid hydrocarbonaceous stream to a fractionation zone to produce a hydrocarbonaceous stream comprising diesel boiling range hydrocarbons and a hydrocarbonaceous stream comprising hydrocarbons boiling at a temperature greater than about 565° C. (1050° F.); and (g) introducing at least a portion of the hydrocarbonaceous stream comprising diesel boiling range hydrocarbons produced in step (f) into the second desulfurization zone.

13. A hydrocracking process for the production of ultra low sulfur diesel wherein the process comprises:

(a) reacting a first hydrocarbonaceous feedstock comprising vacuum gas oil and hydrogen in a hydrocracking zone containing hydrocracking catalyst to produce diesel boiling range hydrocarbons;

(b) introducing a hydrocracking zone effluent produced in step (a) and a second hydrocarbonaceous feedstock having a majority boiling at a temperature greater than about 565° C. (1050° F.) and selected from the group consisting essentially of reduced crude, vacuum reduced crude and tar sand bitumen into a first desulfurization zone containing desulfurization catalyst to produce a first desulfurization zone effluent stream;

(c) passing the first desulfurization zone effluent to a hot, high pressure vapor-liquid separator to recover a vaporous hydrocarbonaceous stream containing hydrogen and a first liquid hydrocarbonaceous stream;

(d) introducing the vaporous hydrocarbonaceous stream containing hydrogen and a third hydrocarbonaceous feedstock comprising diesel boiling range hydrocarbons into a second desulfurization zone containing desulfurization catalyst to produce a second desulfurization zone effluent stream;

(e) passing the second desulfurization zone effluent stream to a cold vapor-liquid separator to recover a hydrogen-rich gaseous stream and a second liquid hydrocarbonaceous stream;

(f) passing the first liquid hydrocarbonaceous stream and the second liquid hydrocarbonaceous stream to a fractionation zone to produce a hydrocarbonaceous stream comprising diesel boiling range hydrocarbons and a hydrocarbonaceous stream comprising hydrocarbons boiling at a temperature greater than about 565° C. (1050° F.); and (g) introducing at least a portion of the hydrocarbonaceous stream comprising diesel boiling range hydrocarbons produced in step (f) into the second desulfurization zone.

* * * * *